United States Patent [19]

Chang

[11] 4,180,760

[45] Dec. 25, 1979

[54] FLAT CATHODE RAY TUBE HAVING MAGNETICALLY COLLIMATED ELECTRON BEAM DEVICE

[75] Inventor: Kern K. N. Chang, Princeton, N.J.

[73] Assignee: RCA Corporation, New York, N.Y.

[21] Appl. No.: 868,230

[22] Filed: Jan. 9, 1978

[51] Int. Cl.[2] ..... H01J 31/08

[52] U.S. Cl. ..... 313/422; 315/366

[58] Field of Search ..... 313/422; 315/366

[56] References Cited

U.S. PATENT DOCUMENTS

| | | | |
|---|---|---|---|
| 2,795,729 | 6/1957 | Gabor | 313/422 X |
| 2,872,607 | 2/1959 | Gabor | 313/422 |
| 2,999,957 | 8/1961 | Schagen et al. | 313/422 |
| 3,177,395 | 4/1965 | Namordi et al. | 313/422 X |

*Primary Examiner*—Robert Segal

*Attorney, Agent, or Firm*—Eugene M Whitacre; George E. Haas; Vincent J. Coughlin, Jr.

[57] ABSTRACT

An evacuated envelope has front and rear walls spaced apart by a plurality of side walls. On the inner surface of the front wall is a cathodoluminescent screen. A magnet structure extends along one of the side walls spaced therefrom and has two spaced poles each of which is parallel to the front wall. The magnet structure generates a uniform magnetic field between the two poles. An electron gun is within the envelope for generating and directing an electron beam into the space between one side wall and the magnet structure. Also included in the device is means for deflecting the electron beam so that it will pass between the poles of the magnet at a plurality of points along the magnet's length. The deflection means maintains a constant angle of incidence at which the electron beam enters the space between the two poles at various points. Means are also included for deflecting the electron beam towards the screen as it emerges from between the magnet poles.

8 Claims, 3 Drawing Figures

FLAT CATHODE RAY TUBE HAVING MAGNETICALLY COLLIMATED ELECTRON BEAM DEVICE

BACKGROUND OF THE INVENTION

The present invention relates to electron beam devices and more particularly to such devices utilizing magnetic collimiation of the electron beam trajectories.

A wide variety of devices have been proposed for reducing the depth of conventional cathode ray tubes. One of the conventional approaches has a single electron gun mounted on the side of the tube in a non-perpendicular relationship to a cathodoluminescent screen. The electron beam generated by the gun initially has a trajectory which is substantially parallel to the screen and at some point in its travel, the beam gets bent sharply toward the screen so that it will impinge thereupon. One of the problems encountered in all of these types of devices is to accurately control the beam trajectory so as to scan a conventional raster such as that utilized in the NTSC, PAL and SECAM television systems. The tendency of the beam trajectory in many of these devices is to scan an arc rather than a straight line producing a picture which has a keystone shape. Another common problem is large variations in spot size at different points on the cathodoluminescent screen due to variation in the angle of incidence at which the electron beam strikes the screen at these different points.

SUMMARY OF THE INVENTION

An image display device has an evacuated envelope with front and rear walls joined by a plurality of side walls. A cathodoluminescent screen is on the front wall. A magnetic structure extends longitudinally along and is spaced from one of the side walls. The magnet structure has two poles spaced apart and each parallel to the front wall so as to generate a uniform magnetic field between the two poles. The magnet collimates the electron beam to provide a raster of parallel lines. A means is also included to deflect the electron beam toward the screen.

DETAILED DESCRIPTION OF THE PRESENT INVENTION

Figure 1:
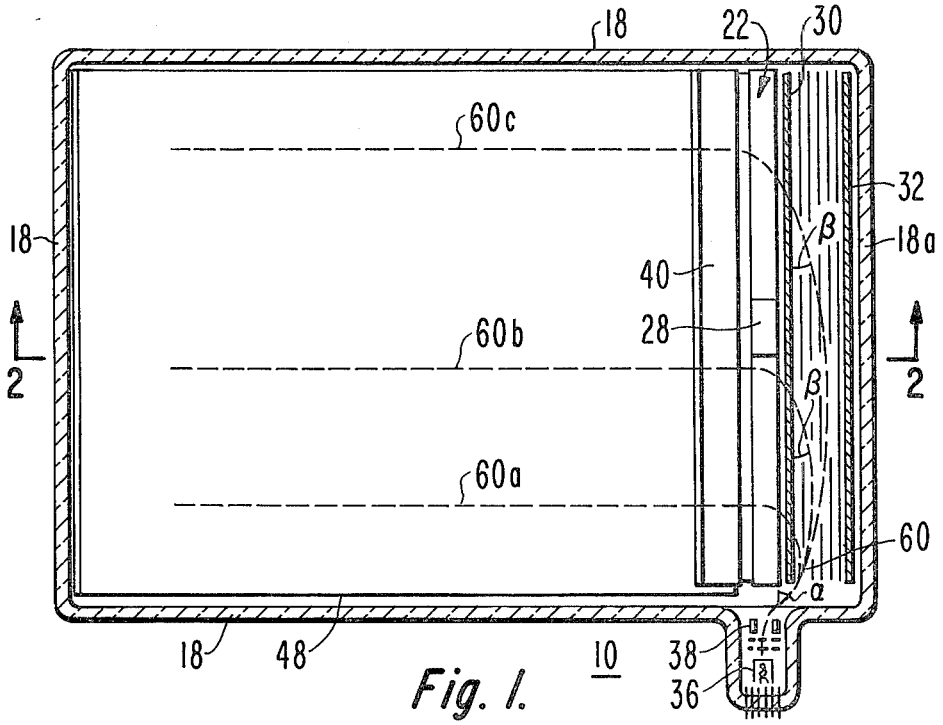
FIG. 1 is a cross-sectional view of the image display device of the present invention.
Figure 2:
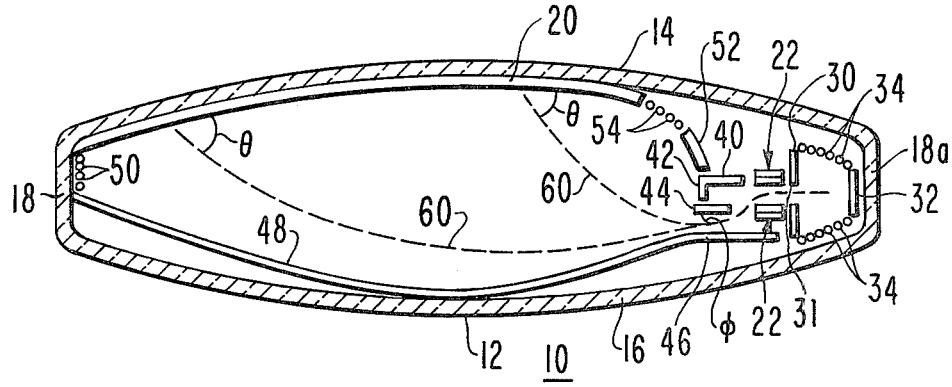
FIG. 2 is a sectional view taken along line 2—2 of FIG. 1.

With initial reference to FIGS. 1 and 2, an image display device generally designated as 10, has an evacuated rectangular envelope 12 formed by a front wall 14 and a rear wall 16 separated by four sidewalls 18. The envelope may be formed by sealing two conventional television tube faceplate panels together. A cathodoluminescent screen 20 is on the interior surface of the front wall 14 and may comprise conventional phosphors used in cathode ray tubes. If the display device 10 is to be used for color display, screen 20 may be composed of a pattern of phosphor materials which emit red, green, and blue light upon electron bombardment.

Figure 3:
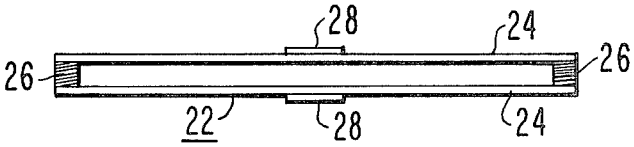
FIG. 3 is a plan view of a component of the device.

Within the envelope is a magnet structure 22, shown in detail in FIG. 3. The magnet 22 includes two parallel spaced metal pole pieces 24 separated at each end by an electromagnet coil 26. The pole pieces are uniform in width so as to produce a uniformly wide magnetic field therebetween. The coils 26 are wound so that one pole piece 24 is magnetically north and the other pole piece 24 is magnetically south. A trimmer permanent magnet 28 is fastened to the middle of each pole piece 24 to increase the magnetic field at that point so that a uniform magnetic field exists along the length of the pole pieces 24 between the electromagnetic coils 26. The magnet structure 22 is positioned within the envelope with the pole pieces 24 substantially parallel to the front wall 14 and one side wall **18*a*. The magnet structure 22 forms a magnetic electron beam collimator. Alternately, the magnet 22** may be positioned on the outside of the tube or formed of two spaced overlapping permanent magnets with opposing poles facing each other.

Between the magnet 22 and the one side wall **18*a* is an electrode plate 30 of magnetic material having a slit aperture 31 aligned with the center of the opening between the two pole pieces 24. A repeller electrode 32 extends between the slit electrode 30 and the one side wall 18*a* parallel to the slit electrode. A plurality of first electrode rods 34 extend between and are parallel to the slit electrode 30 and the repeller electrode 32 along both the front and rear walls 14 and 16, respectively. An electron gun 36 extends at right angles from another sidewall 18 normal to the one sidewall 18*a* and aligned with the magnet 22. The electron gun 36 has deflection electrodes 38 for deflecting a beam of electrons between the magnet 22 and the repeller electrode 32**.

On the remote side of the magnet structure 22 from the one side wall **18*a* is a first deflection electrode 40 having an L shape and including a short leg 42. The first electrode 40 is substantially coplanar with the magnet pole piece 24 nearest the front wall extending along the length of the pole piece with the short leg 42 of the L remote from the magnet 22 and pointing toward the rear wall 16. A second deflection electrode 44 is substantially coplanar with and spaced from the other pole piece 24. A rear deflection electrode 48 extends along the rear wall 16 from the slit electrode 30 to the sidewall 18 opposite the one side wall 18*a*. The rear deflection electrode 48 is generally concave with respect to the front wall 14 and has a flat portion 46 parallel to the second electrode 44. A plurality of second electrode rods 50 extend parallel to the opposite sidewall between the rear electrode 48 and the front wall 14. Between the first deflection electrode 40 and the front wall is a third deflection electrode 52 and a plurality of third electrode rods 54 between the third electrode 52 and the front wall 14**.

During the operation of the display, the repeller electrode 32 is biased to between 1.5 to 3 kilovolts (Kv) and the slit electrode is biased at 5 Kv. The first rods 34 are biased at increasing voltage increments from about 1.5 to 3 Kv. on the rod 34 nearest the repeller electrode 32 to about 5 Kv. on the rod nearest the slit electrode 30. The magnet structure 22 generates a uniform field of about 100 gauss between the pole pieces 24. The first and second deflector electrodes 40 and 44 are biased to 5 Kv. and about 6 Kv., respectively. The rear electrode 48 has 4.8 to 5 Kv. applied to it. The screen 20 and the third deflection electrode 52 are biased to 25 and 3 Kv., respectively.

The electron gun 36 generates an electron beam 60 which is directed by deflection electrodes 38 within the gun along an initial trajectory between the magnet structure 22 and the repeller electrode 32. The angle of deflection $\alpha$ at which the beam 60 is deflected from the gun 36 is maintained constant. By varying the voltage on the repeller electrode 32, the trajectory of the electron beam 60 may be varied as indicated by the three trajectories 60*a, b,* and *c*. A more positive voltage applied to the repeller electrode 32 results in the beam travelling farther between the magnet structure 22 and the repeller electrode as indicated by trajectory 60*c* for example. By proper selection of the electrode potentials between the slit electrode 30 and the repeller electrode 32, a retarding electric field is established which causes the electron beam to have parabolic trajectories. The parabolic trajectory insures that the angle $\beta$ with which the electron beam enters the magnet structure 22 will equal the initial deflection angle $\alpha$. Since, the parabolic trajectory is maintained for all of the various positions at which the electron beam enters the magnet structure 22, the beam will have a constant angle of entry into the uniform magnetic field formed between the pole pieces 24, and therefore, will be equally affected by the field regardless of point of entry. The angles $\alpha$ and $\beta$ should typically be between 30° and 60° with a nominal value of 45°. Substantial defocusing of the beam occurs when the angle is less than 30° or greater than 60°. The rod electrodes 34 prevent external electromagnetic fields from entering the parabolic deflection region between magnet 22 and the repeller electrode 32.

As the beam passes between the pole pieces 24 the different beam trajectories are collimated so as to produce a plurality of parallel scan lines as indicated by the trajectories 60*a, b,* and *c*. Since the magnetic field is constant and uniform in width along the entire length of the magnet structure 22, and since the beam's angle of incidence $\beta$ is constant for all of the points of entry, the collimating effects of the magnetic field will be equal for all beam trajectories. Proper selection of the magnetic field intensity produces parallel horizontal scan lines.

As the beam emerges from between the pole pieces 24, the biasing of the first, second and rear deflection electrodes 40, 44, and 46, respectively, and the curvature of the rear electrode 46, causes the beam to pass between the pole piece 24 nearest the rear wall 16 and the second electrode 44 at a constant angle $\phi$. The angle $\phi$ and the biasing on the rear electrode 48, the screen 20, and the third deflection electrode 52 causes the beam 60 to follow a second generally parabolic trajectory. The second parabolic trajectory results in the beam 60 impinging upon the screen at a substantially constant angle $\theta$. The curvature of the screen 20, which is somewhat exaggerated in the drawing, will cause a slight variation in the actual angle of incidence as the electron beam scans a single line.

The dual ballistic deflection of the parabolic trajectories, provide strong focussing in both the horizontal and vertical dimensions to produce a uniformly small electron beam spot size at the screen 20. The spot size is improved over conventional deflection systems. The magnetic collimation permits parabolic trajectories to be used in a flat rectangular envelope which is easily fabricated and incorporated into a display system.

For the orientation of the device as shown in FIG. 1, the vertical deflection is achieved by the biasing of the repeller electrode 32 so as to cause the electron beam to enter the magnet structure at various positions along the magnet's length. The horizontal scanning is achieved by variation of the potential applied to the magnet electrodes 26 and 28 to deflect the electron beam to various positions on the screen along a given scan line. However, the tube could be oriented at 90° to the orientation in FIG. 1 so that the repeller electrode 32 provides horizontal scanning and the magnet electrodes 26 and 28 provide the vertical positioning of the beam.

I claim:

1. An image display device comprising:

an evacuated envelope having front and rear walls and a plurality of side walls between the front and rear walls;

a cathodoluminescent screen on the front wall;

a magnet structure extending longitudinally along and spaced from one side wall and having two poles spaced from one another, the magnet structure generating a uniform magnetic field between the two poles;

an electron gun for generating and directing an electron beam into the space between the one side wall and the magnet structure;

a first deflection means for deflecting said electron beam in a substantially parabolic trajectory so that it will pass between the poles of the magnet structure at various points along the magnet's length while maintaining a constant angle of incidence at which the electron beam enters the space between the magnet poles; and a second deflection means for deflecting the electron beam toward the screen in a substantially parabolic trajectory after it passes between the poles of the magnet structure so that the beam impinges upon the screen at a substantially constant angle of incidence.

2. A display device as in claim 1 wherein the first deflection means comprises a repeller electrode spaced from and parallel to the magnet structure adjacent to the one side wall.

3. The device as in claim 2 further comprising means for preventing external electromagnetic fields from penetrating between the repeller electrode and the magnet structure.

4. The device as in claim 1 wherein the second deflection means comprises:

a first electrode on the side of the magnet structure remote from the one side wall;

a second electrode spaced from and parallel to the first electrode between the first electrode and the rear wall, the second electrode being spaced from the magnet structure;

a rear electrode having a first portion between the second electrode and the rear wall and a second portion extending between the first portion and the side wall opposite the one side wall, the second portion being concave with respect to the front wall.

5. The device as in claim 4 further comprising means for preventing external electromagnetic fields from penetrating between the screen and the rear electrode.

6. The device as in claim 1 wherein the magnet structure has a uniform width.

7. The device as in claim 1 wherein the first deflection means deflects the beam between the poles at an angle between 30 and 60 degrees.

8. The device as in claim 7 wherein the second deflection means deflects the beam so that the beam has an angle of incidence at the screen between 30 and 60 degrees.

* * * * *

UNITED STATES PATENT AND TRADEMARK OFFICE
CERTIFICATE OF CORRECTION

PATENT NO. : 4,180,760

DATED : December 25, 1979

INVENTOR(S) : Kern Ko Nan Chang

It is certified that error appears in the above-identified patent and that said Letters Patent is hereby corrected as shown below:

| Patent | Application | |
|---|---|---|
| claim 1, line 9 | claim 1, line 8 | after "uniform" insert --and constant--. |

Signed and Sealed this

*Twenty-second* Day of *April 1980*

[SEAL]

*Attest:*

SIDNEY A. DIAMOND

*Attesting Officer*

*Commissioner of Patents and Trademarks*